US006394201B1

(12) United States Patent
Feigel, Jr. et al.

(10) Patent No.: US 6,394,201 B1
(45) Date of Patent: May 28, 2002

(54) TUBING SPIDER

(75) Inventors: Kurt Feigel, Jr.; Vladimir G. Pohnert, both of Edmonton (CA)

(73) Assignee: Universe Machine Corporation, Edmonton (CA)

( * ) Notice: Subject to any disclaimer, the term of this patent is extended or adjusted under 35 U.S.C. 154(b) by 16 days.

(21) Appl. No.: 09/670,341

(22) Filed: Sep. 27, 2000

Related U.S. Application Data

(60) Provisional application No. 60/157,124, filed on Oct. 4, 1999.

(51) Int. Cl.[7] ..... E21B 19/10

(52) U.S. Cl. ..... 175/423; 166/75.14; 188/67

(58) Field of Search ..... 175/423; 166/75.14, 166/75.53; 188/67; 24/463

(56) References Cited

U.S. PATENT DOCUMENTS 1,555,379 A * 9/1925 Moody ..... 188/67
1,966,454 A * 7/1934 Moody ..... 188/67
2,071,637 A 2/1937 Laurent
3,096,075 A * 7/1963 Brown ..... 166/77.4
3,579,752 A * 5/1971 Brown ..... 188/67
4,306,339 A * 12/1981 Ward ..... 188/67
4,332,062 A 6/1982 Bvrne
4,355,443 A * 10/1982 Blackwell ..... 188/67
4,361,940 A 12/1982 McFadden
4,381,584 A * 5/1983 Coyle, Jr. ..... 166/97.5
4,417,846 A 11/1983 Elliston
4,715,456 A 12/1987 Poe et al.
5,524,710 A 6/1996 Shinn
5,791,410 A 8/1998 Castille et al.
5,848,647 A * 12/1998 Webre et al. ..... 166/379
5,909,768 A 6/1999 Castille et al.

OTHER PUBLICATIONS

B. J. Hughes catalogue, p. 79 "Tubing Spiders".
Oil County Manufacturing Inc. catalogue, p. 3 "Tubing Spider".
Oil County Manufacturing Inc. catalogue, p. 7 "Tubing Spider".
Varco B. J. Oil Tools, catalogue, p. 20 "Tubing Spiders".
Cavins Oil Well Tools catalogue, p. 598 "Cavins Advance Automatic Spiders and Cavins Advance Spider".
Cavins Oil Well Tools Catalogue, p. 600 "Cavins Inverted Spider".

* cited by examiner

*Primary Examiner*—Hoang Dang
(74) *Attorney, Agent, or Firm*—Bennett Jones LLP

(57) ABSTRACT

A tubing spider includes a rigid support frame having a plurality of support posts and an upper and lower support ring separated by said support posts, a pyramidal frustum formed by a plurality of inclined planes rigidly attached to the support frame, a plurality of slips moveable along the inclined planes and hydraulic cylinders for actuating the slips. The pyramidal frustum and the range of travel of the slips extends substantially the entire length of the support frame between the upper and lower support rings. These slips define a cylindrical opening, the diameter of which changes as the slips move along the range of travel. In one embodiment, the support frame may be opened up as the upper and lower support rings are comprised of two hemispherical halves which are joined together in a hinged manner.

13 Claims, 7 Drawing Sheets

TUBING SPIDER

This application claims priority from U.S. Provisional Application No. 60/157,124, filed Oct. 4, 1999.

FIELD OF THE INVENTION

The present invention relates to devices, commonly referred to as spiders, which engage, hold and support drill pipe or tubing in order to prevent the pipe or tubing from exerting a downward force in the well bore.

BACKGROUND OF THE INVENTION

Spiders are important in well drilling and servicing operations because they hold the drill pipe so that the weight of the pipe does not exert a downward force into the well. In some cases, the spider may be inverted so as to hold the pipe against upward movement.

An essential feature of a spider is a mechanical means for exerting lateral pressure against the pipe in order to hold its vertical position. Typically, this lateral or radial pressure is generated by a bowl with an opening extending through it in the shape of a conical or pyramidal frustum. The smaller end of the opening is at the lower end of the spider. Slips which engage the bowl surface translate vertical motion of the pipe into a reactive lateral force to squeeze the pipe between the slips.

Hydraulic work-over, or snubbing, services for oil wells are increasingly favoured, having the advantage of eliminating the need to kill the well. In a snubbing operation, it is necessary to use two spiders where one is inverted to grip the pipe and prevent it from moving in either direction. Typically, it is necessary to use four spiders, two of which are inverted. The spiders conventionally used in snubbing operations include slips which pivot into and out of their pipe-engaging position. An example is found is U.S. Pat. No. 4,715,456. Because of the configuration of these spiders, all four spiders cannot be stacked on top of each other. They must be split into two pairs, with a weight-bearing element between them. It would be preferable to eliminate this wasted space to allow the spider configuration to be more compact.

Spiders are known to freeze or otherwise lock up in use. When this occurs, it is typically necessary to cut the spider open to disengage the slips. Also, it is sometimes necessary to pass a larger element of the drill pipe through the spider such as a drill collar or a dog nut which may be larger than the slip opening of prior art spiders will allow. In these cases, it would be preferable to provide a means for disengaging the spider without destroying the spider and perhaps ensuring that the spider may be reused.

SUMMARY OF THE INVENTION

The present invention is directed to an improved spider which is compact and robust in construction to allow its use in a limited space. The spider of the present invention may be stacked and bear a full load in a stacked configuration. The spider may be non-destructively opened up in use to disengage it from the drill pipe where necessary.

Accordingly, in one aspect of the invention, the invention comprises an apparatus for engaging, holding and supporting drill pipe or tubing comprising:

(a) a rigid support frame comprising a plurality of support posts each having a lower end and an upper end, a lower support ring engaging the lower end of each support post and an upper support ring engaging the upper end of each support post, wherein said support frame defines a central bore;

(b) a pyramidal frustum comprising a plurality of inclined planes rigidly attached to the support frame and lining the central bore;

(c) a plurality of slips moveable along the inclined planes, each slip interlocking with an inclined plane in a tongue-and-groove or dovetail manner and having a substantially vertical pipe-engaging surface;

(d) means for moving the slips;

wherein the pyramidal frustum and the range of travel of the slips extends substantially the entire length of the support frame between the upper and lower support rings and wherein the pipe-engaging surfaces define a cylindrical opening the diameter of which changes as the slips move along their range of travel.

In a preferred embodiment, each of the upper and lower support rings is comprised of two hemispherical halves which are joined together in a hinged manner such that the rings may be opened or closed. Preferably, the slip moving means comprises two hydraulic cylinders each with a mechanical linkage wherein one cylinder simultaneously moves a first pair of adjacent slips and a second cylinder moves a second pair of adjacent slips. More preferably, movement of the first pair of slips is synchronized with movement of the second pair of slips by means of a horizontal timing bar which slidingly engages a slip of the first pair and an adjacent slip of the second pair.

In a preferred embodiment, the apparatus further comprises a travel limiting block associated with the upper support ring which is moveable between a first position where it does not contact the slip moving means and a second position where it does contact the slip moving means, thereby limiting the upward travel of the slips. The travel limiting block is pivotably attached to the upper support ring and pivots between its first and second position.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

Figure 1:
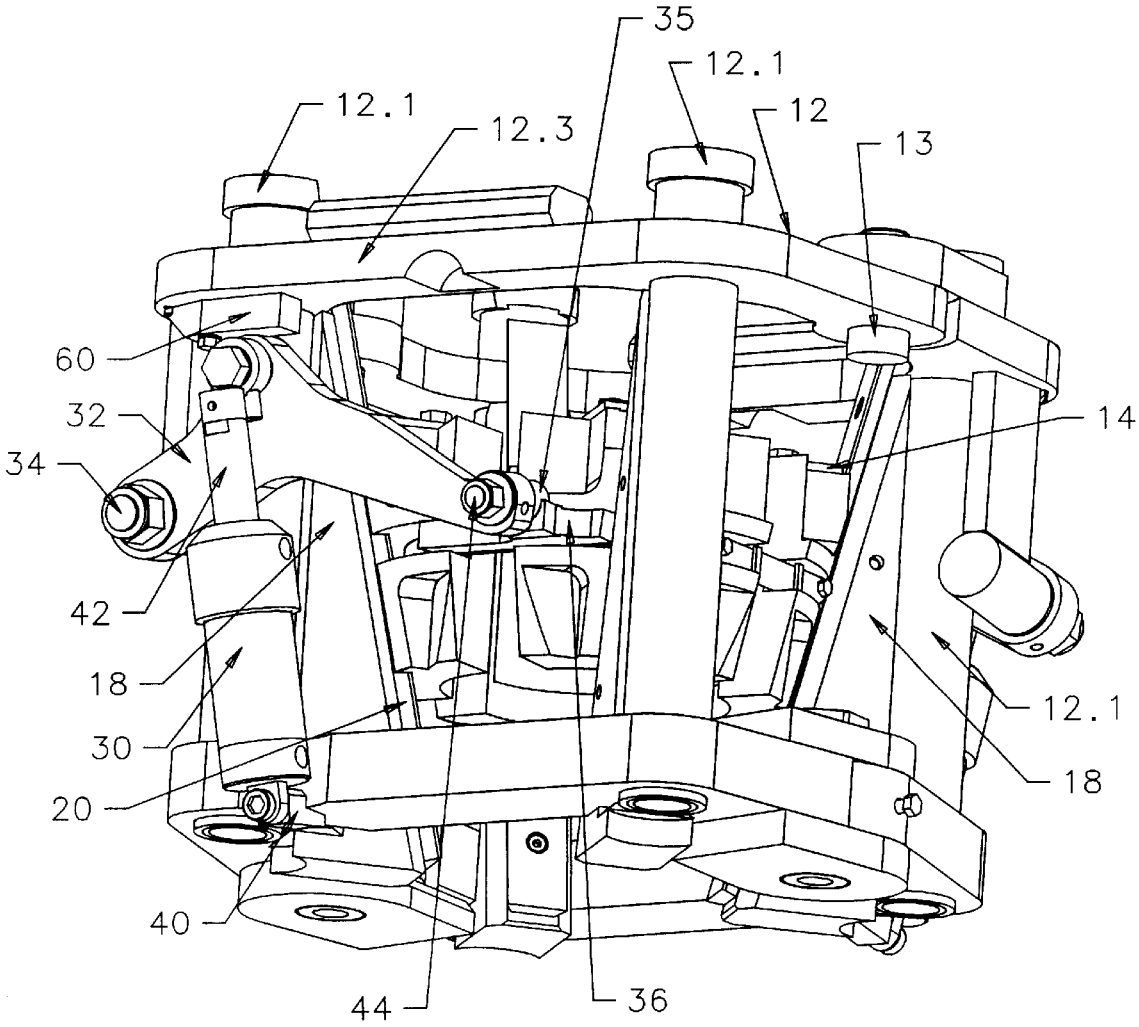
FIG. 1 is a perspective view of a preferred embodiment.

The present invention provides for an apparatus for engaging, holding and supporting drill pipe or tubing in order to prevent the pipe or tubing from exerting a downward force in a well bore. The apparatus will be referred to herein as a spider (10). All terms not defined herein have their common art-recognized meanings.

The preferred embodiment of the spider (10) according to the Figures comprises a frame (12) and slips (14) which travel vertically within the frame (12). The frame (12) is assembled from vertical support posts (12.1), a lower support ring (12.2) and an upper support ring (12.3). The support rings (12.2, 12.3) are rigidly affixed to and spaced apart by the support posts (12.1). The slips (14) define a central cylindrical bore or slip opening (16) which has an axis parallel to the support posts and which is vertical when the spider (10) is in operation.

Figure 4:
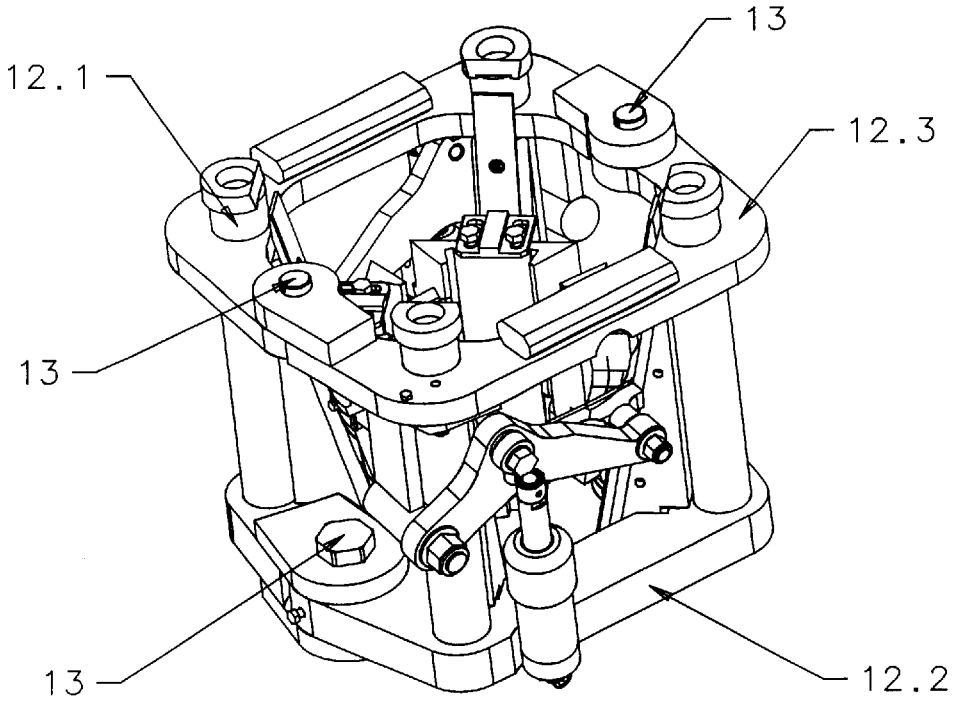
FIG. 4 is a perspective view of the frame assembly of the preferred embodiment.
Figure 5:
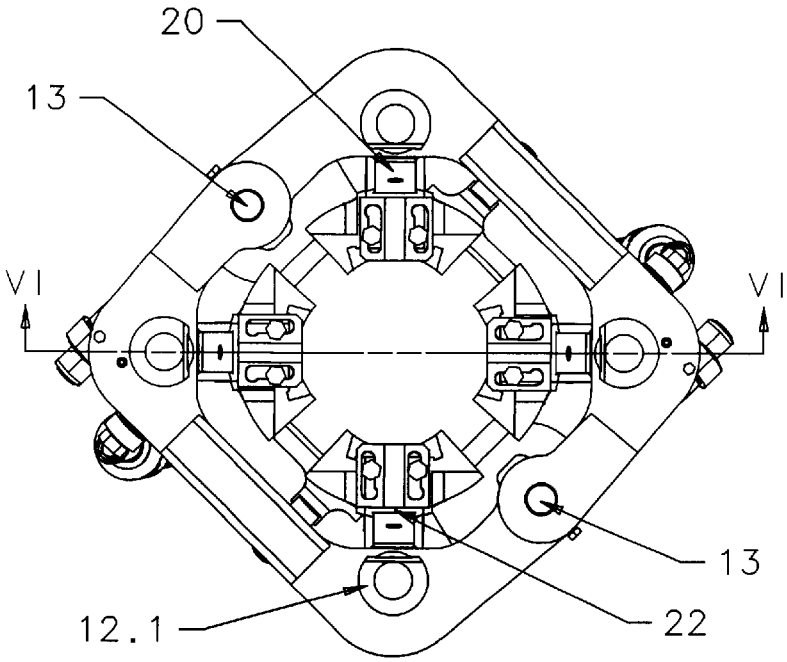
FIG. 5 is a top plan view of the preferred embodiment.
Figure 6:
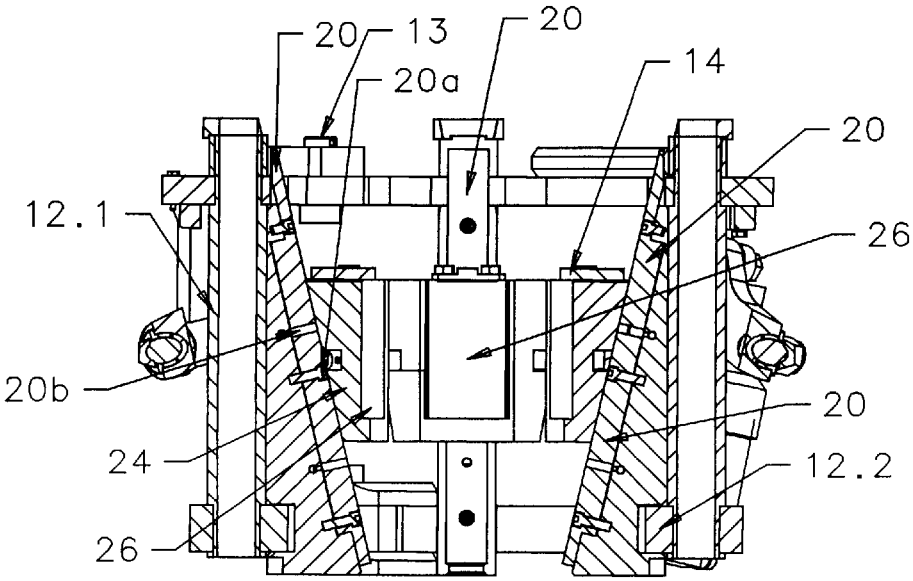
FIG. 6 is a cross-sectional view along line 6—6 in FIG. 5.
Figure 7:
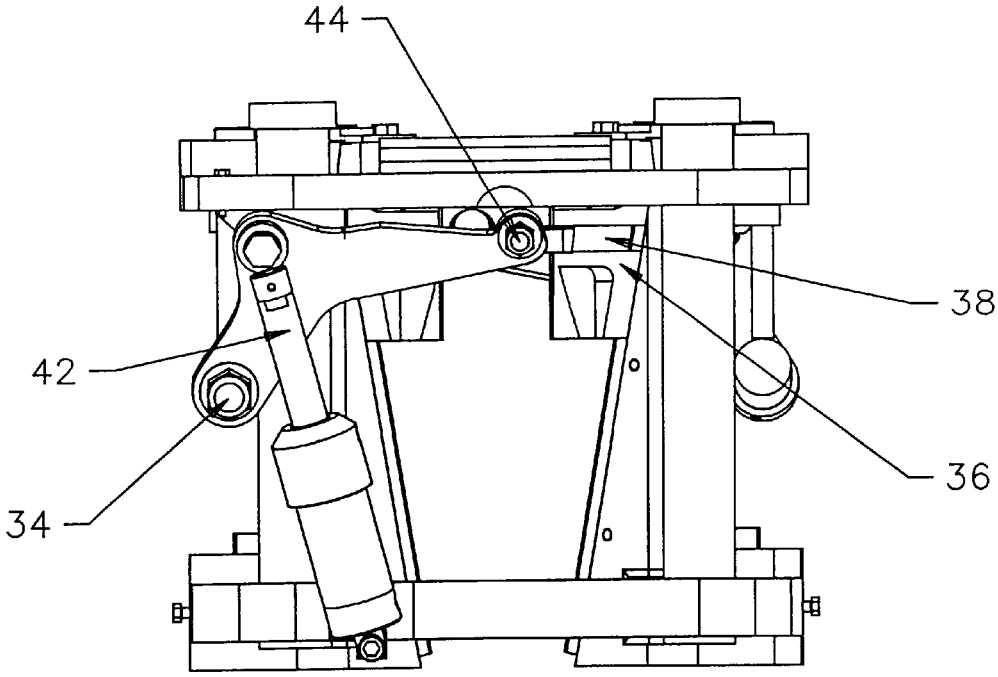
FIG. 7 is a side view showing the slips in an open (raised) position.
Figure 8:
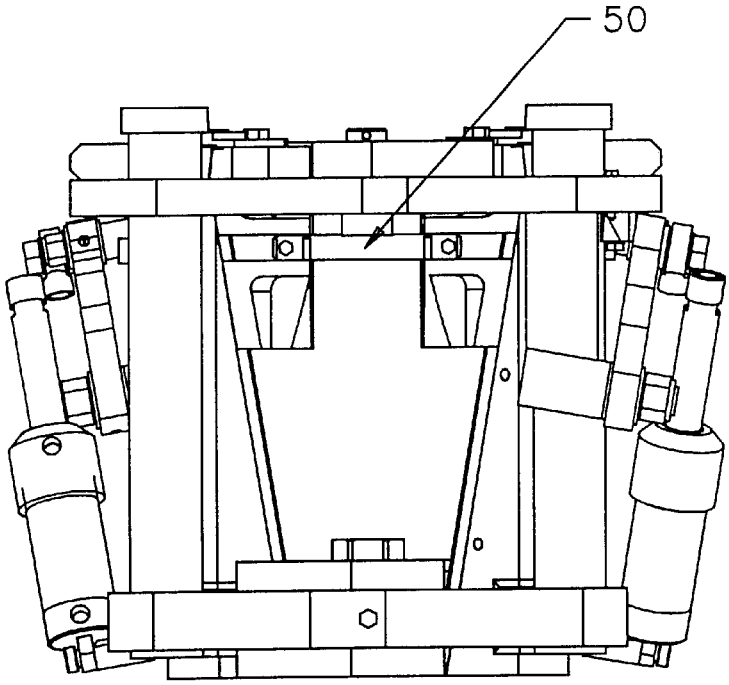
FIG. 8 is an alternate side view of the spider shown in FIG. 7.
Figure 9:
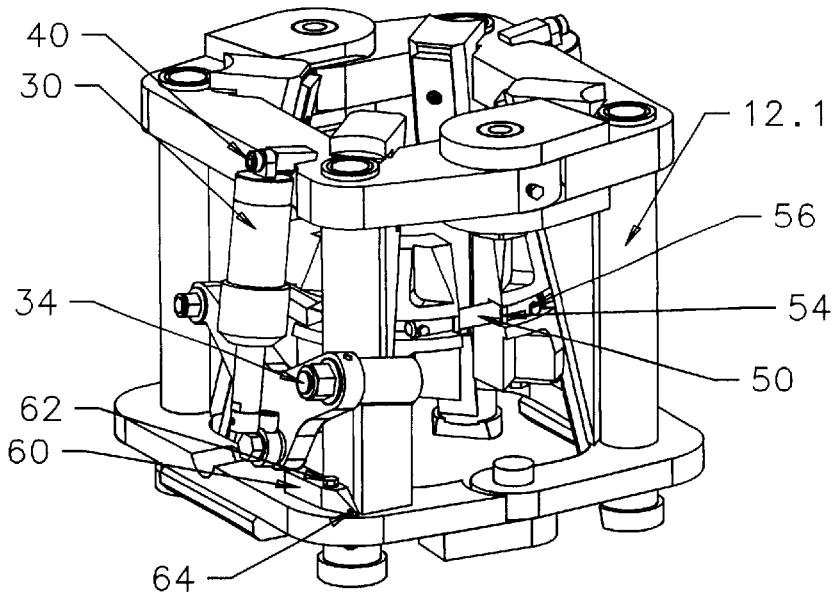
FIG. 9 is a perspective view of the preferred embodiment in an inverted position.
Figure 10:
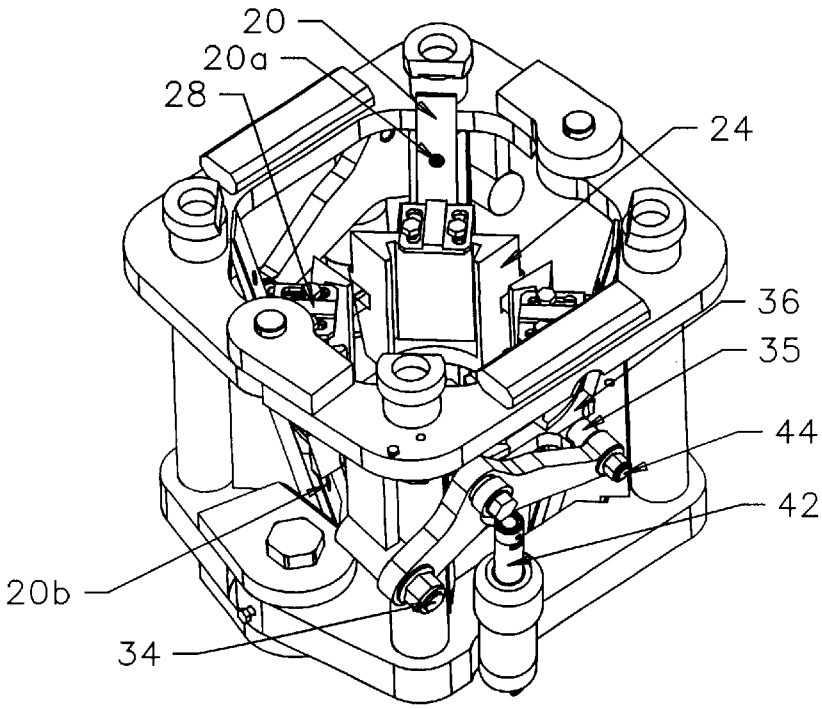
FIG. 10 is a perspective view of the preferred embodiment.

The frame is preferably constructed as is illustrated in FIG. 4. As will be apparent to one skilled in the art, the frame is composed of two halves which are joined together by hinge pins (13). Therefore, each of the upper and lower support rings are comprised of two hemispherical elements which join together to form a ring. When the hinge pins (13) on one side are removed, the frame (12) may be opened like a clam shell. Each half of the lower support ring is identical and has one end which is adapted to mate with the other end, as is illustrated in the Figures. The upper support ring is also comprised of two identical halves which overlap in the manner shown. In the specific embodiment illustrated, the lower support ring is more robust than the upper support ring. It is of course possible to make the two equally robust, as is necessary for the particular circumstances of its use. It is not intended to limit this invention to the particular hinging configurations shown. What is important is that the frame is capable of being opened up yet remain sturdy and act monolithically in use.

In the preferred embodiment, there are four support posts (12.1) and four slips (14), each of which forms approximately one-quarter of the circumference of the slip opening (16). Each support post has an associated wedge (18) rigidly affixed to it. The wedge (18) forms the inclined plane which translates vertical motion of the slips into a lateral or radial inward force. The wedges are faced with an insert (20) which has a dove-tailed cross-sectional profile for engaging a corresponding groove (22) in a slip (14). Because the inserts will wear relatively quickly due to the transferance of force from the slips (14) to the frame (12), the inserts are preferably removable and replaceable and held in place by appropriate bolts (20*a*) and pins (20*b*).

Each slip (14) has a body (24) which defines the aforementioned groove (22) and to which is attached a gripping die (not shown) which is preferably a hardened steel element, which is well known in the art. The gripping die is held in place by a die keeper (28) which bolts to the slip body (24). The gripping dies (26) are replaceable as they wear in normal use.

Adjacent pairs of slips (14) on one half of the frame (12) are activated by a hydraulic cylinder (30) acting through a pivot arm (32). Therefore, there are two cylinders (30) where there are four slips. Referring to FIG. 1, the pivot arm (32) pivots on fixed point (34) on the frame and is pivotally attached to a lifting bar (36) which engages a slot (38) in the body (24) of two adjacent slips (14). Because the distance between two adjacent slips varies as the slips move up and down, it is necessary that the lifting bar (36) slide transversely within the slots (38).

Figure 2:
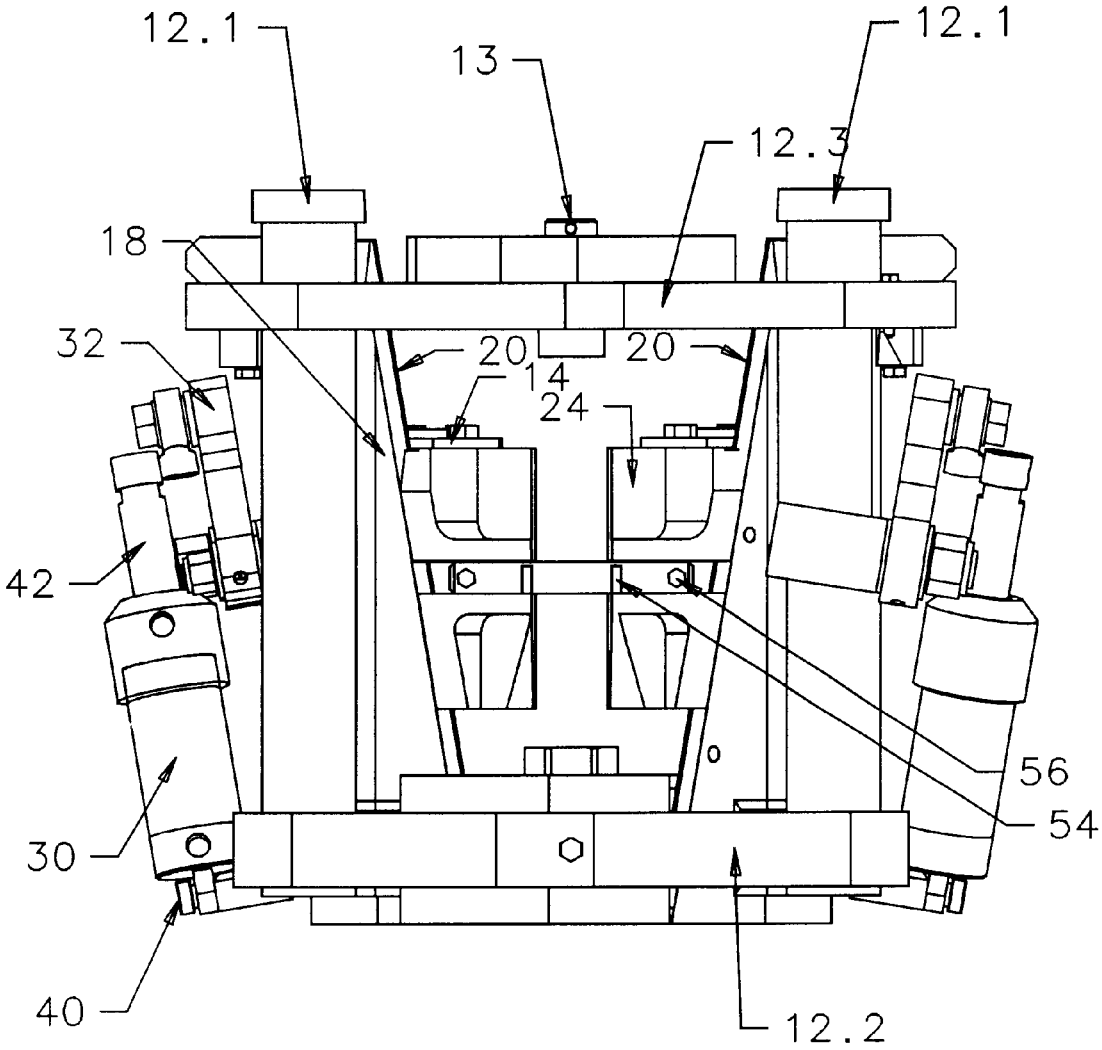
FIG. 2 is a side view of the preferred embodiment.
Figure 3:
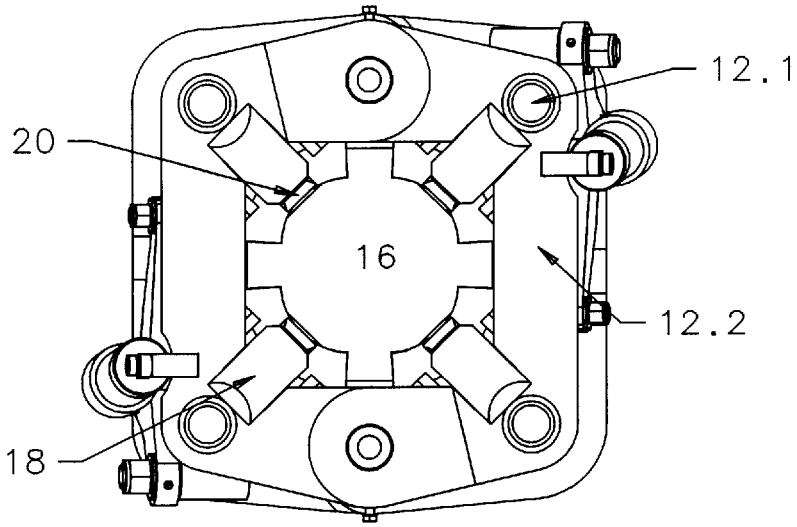
FIG. 3 is a bottom view of the preferred embodiment.

The hydraulic cylinder is rigidly attached to the frame (12) at attachment point (40). The hydraulic ram (42) engages the pivot arm (32) between the pivot point (34) and the attachment point (44) of the pivot arm to a linking arm (35) which in turn attaches to the lifting bar (36). Therefore, the pivot arm acts as a lever arm and applies the force of the hydraulic cylinder accordingly. Preferably, the longitudinal axis of the cylinder (30) is offset from vertical as is illustrated in FIG. 2 at an angle equal to the incline angle of the wedges (18). Accordingly, the cylinder (30), the pivot arm (32) and the line of travel of the slips (14) remain parallel throughout the range of motion of the slips (14). Accordingly, the lifting bar does not move radially within the slot (38) while it moves laterally. The slot is however horizontal in the preferred embodiment. As a result, the linking arm (35) between the pivot arm (32) and the lifting bar (36) is slightly angled.

It is important to synchronize movement of opposing pairs of slips (14). In the preferred embodiment, this is accomplished by two timing bars (50) which extend between matched slips (14) of opposing slip pairs as is shown in FIG. 2. Each timing bar (50) engages timing slots (52) in the matched slip bodies (24). Retaining pins (54) and protruding hex bolts (56) ensure that the timing bars (50) remain within the timing slots (52) while allowing sufficient lateral movement of the timing bar (50) within the slot (52).

For ease of fabrication, the timing slots (52) and the lifting slots (38) are identical. Therefore, each slip (14) is identical and it is not necessary to match slips according to their position.

As is apparent, in order to unhinge the spider (10) during use, the hinge pins (13) on one side are removed as well as the timing bar (50) on the same side. The spider may then be removed from the drill pipe even if the slips are in a engaged position. Of course, it will be necessary to have the weight of the drill pipe supported by alternate means when doing so.

The long range of travel of the slips (14) allows the opening to become large enough to allow drill collars or dog nuts (not shown) to pass through without disassembling the slip. At the same time, because the wedges are braced at both the top and the bottom by the lower and upper support rings, the slips may be set against a pipe of larger diameter with the same force as one of smaller diameter.

Figure 11:
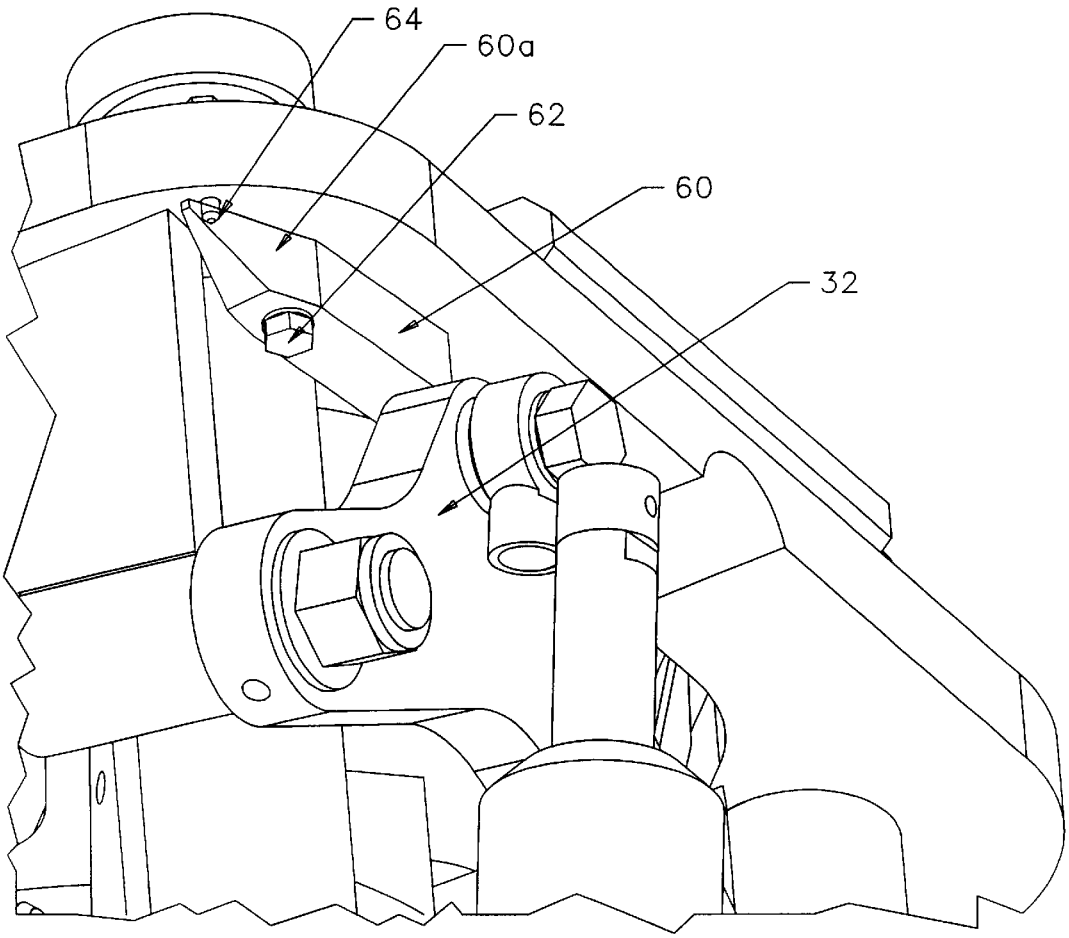
FIG. 11 is a detailed view of the travel limiting block in its disengaged position.

It is sometimes desirable to limit the travel of the slips (14) where one is operating the spider with pipe or tubing that is uniform in diameter and only a small range of travel is necessary to set and release the slips (14). Therefore, in the preferred embodiment, a travel limiting block (60) is provided on the underside of the upper support ring (12.3), as is shown in FIG. 11. The block (60) is positioned such that it interferes with the pivot arm (32) at the upper end of the pivot arm's (32) range of motion. The block (60) may be pivoted out of the way of the pivot arm (32) when a full range of motion is desired. The block (60) is therefore attached to the upper support ring by a pin or bolt (62) which allows such pivoting. One end (60*a*) of the block is shaped such that a retaining pin (64) will prevent the block from moving to its engaged or disengaged position, as the case may be. In FIG. 11, the block is shown in its disengaged position. To move to its engaged position, where it will limit travel of the pivot arm, it must be turned counter-clockwise. Obviously, the retaining pin (64) prevents that movement. After the pin is removed, the block may be rotated to its engaged position whereupon the pin may be reinserted to prevent clockwise movement of the block back to its disengaged position.

The long range of travel of the slips (14) also allows the spider (10) to be configured with narrow angle wedges. Generally, the narrower the angle (closer to vertical), the greater lateral or radial force may be applied through the slips. Therefore, by giving the slips a greater range of travel, the entire range of which is enclosed by the support frame, the spider may have a greater ability to grip the pipe while maintaining the range of slip opening (16) to accommodate drill collars or wider diameter pipe. Therefore, in a preferred embodiment, the wedges present an inclined plane which is a 13° angle from vertical. This angle may vary from 8° to about 20° and the frame dimensions may be varied to provide the necessary size range of slip opening (16).

This description assumes that the spider depicted in the Figures has the orientation shown in FIG. 1, where movement of the slips (14) upward increases the diameter of the opening defined by the slips (14). Of course, it is well-known to use spiders in a configuration inverted from that shown in FIG. 1. It is intended that this patent cover both configurations.

As will be apparent to those skilled in the art, various modifications, adaptations and variations of the foregoing specific disclosure can be made without departing from the scope of the invention claimed herein.

What is claimed is:

1. An apparatus for engaging, holding and supporting drill pipe or tubing comprising:

(a) a rigid support frame comprising a plurality of support posts each having a lower end and an upper end, a lower support ring engaging the lower end of each support post and an upper support ring engaging the upper end of each support post, wherein said support frame defines a central bore;

(b) a pyramidal frustum comprising a plurality of inclined planes rigidly attached to the support frame and lining the central bore;

(c) a plurality of slips moveable along the inclined planes, each slip interlocking with an inclined plane in a tongue-and-groove or dovetail manner and having a substantially vertical pipe-engaging surface;

(d) means for moving the slips;

wherein the pyramidal frustum and the range of travel of the slips extends substantially the entire length of the support frame between the upper and lower support rings and wherein the pipe-engaging engaging surfaces define a cylindrical opening the diameter of which changes as the slips move along their range of travel.

2. The apparatus of claim 1 wherein each of the upper and lower support rings is comprised of two hemispherical halves which are joined together in a hinged manner such that the rings may be opened or closed.

3. The apparatus of claim 1 wherein there are four inclined planes and four associated slips.

4. The apparatus of claim 3 wherein the slip moving means comprises two hydraulic cylinders each with a mechanical linkage wherein one cylinder simultaneously moves a first pair of adjacent slips and a second cylinder moves a second pair of adjacent slips.

5. The apparatus of claim 4 wherein movement of the first pair of slips is synchronized with movement of the second pair of slips by means of a horizontal timing bar which slidingly engages a slip of the first pair and an adjacent slip of the second pair.

6. The apparatus of claim 1 further comprising a travel limiting block associated with the upper support ring which is moveable between a first position where it does not contact the slip moving means and a second position where it does contact the slip moving means, thereby limiting the upward travel of the slips.

7. The apparatus of claim 6 wherein the travel limiting block is pivotably attached to the upper support ring and pivots between its first and second positions.

8. The apparatus of claim 7 further comprising means for retaining the travel limiting block in either its first or second position.

9. The apparatus of claim 8 wherein the retaining means comprises a removeable pin engaging the upper support ring.

10. The apparatus of claim 1 wherein the inclined planes are inclined away from vertical by an angle which is less than about 20°.

11. The apparatus of claim 10 wherein the inclined planes are inclined away from vertical by an angle which is about 13°.

12. The apparatus of claim 1 wherein each inclined plane comprises a guide insert which engages the slip and which is removeable and replaceable.

13. The apparatus of claim 1 wherein the apparatus is adapted such that it may be stacked with other apparatuses of similar configuration, one on top of the other, inverted or not, and bear a full load as if it were a single apparatus properly supported.

* * * * *